US007100649B2

(12) United States Patent
Liu

(10) Patent No.: US 7,100,649 B2
(45) Date of Patent: Sep. 5, 2006

(54) ROTARY CUTTER FOR A WOOD PLANING MACHINE

(75) Inventor: Chin Yuan Liu, Taichung (TW)

(73) Assignee: Shinmax Industry Co., Ltd., Taichung Hsien (TW)

( * ) Notice: Subject to any disclaimer, the term of this patent is extended or adjusted under 35 U.S.C. 154(b) by 0 days.

(21) Appl. No.: 11/053,450

(22) Filed: Feb. 8, 2005

(65) Prior Publication Data

US 2005/0263213 A1 Dec. 1, 2005

(30) Foreign Application Priority Data

Mar. 5, 2004 (TW) ..... 93203293 U

(51) Int. Cl.

| | |
|---|---|
| ***B27C 1/02*** | (2006.01) |
| ***B27G 13/02*** | (2006.01) |
| ***B27D 1/12*** | (2006.01) |
| *B27C 5/02* | (2006.01) |

(52) U.S. Cl. ..... 144/117.1; 144/218; 144/225; 144/230; 407/48; 83/698.41

(58) Field of Classification Search ..... 144/114.1, 144/117.1, 121, 129, 130, 218, 221, 230, 144/225–227; 407/40, 47, 48, 107; 83/698.41, 83/698.42, 698.51, 699.51

See application file for complete search history.

(56) References Cited

U.S. PATENT DOCUMENTS

| | | | | |
|---|---|---|---|---|
| 1,294,638 | A * | 2/1919 | Draper | 144/225 |
| 4,066,111 | A * | 1/1978 | Klebe, Jr. | 30/475 |
| 5,398,739 | A * | 3/1995 | Everts et al. | 144/225 |
| 6,626,214 | B1 * | 9/2003 | Hu | 144/221 |

* cited by examiner

*Primary Examiner*—Derris H. Banks
*Assistant Examiner*—Shelley Self
(74) *Attorney, Agent, or Firm*—Frommer Lawrence & Haug LLP; Ronald R. Santucci

(57) ABSTRACT

A rotary cutter includes: an elongated shaft that defines a rotation axis and that has two opposite mounting ends, and at least one axially extending blade-mounting surface parallel to the rotation axis and extending between the mounting ends; a pair of blade-aligning members, each of which is mounted on a respective one of the mounting ends of the shaft, and each of which is formed with at least one protrusion; at least one blade attached to the blade-mounting surface and having two opposite end portions, each of which is formed with a recess that receives the protrusion of a respective one of the blade-aligning members; and a fastening plate and screws for fastening the blade to the shaft.

4 Claims, 7 Drawing Sheets

ROTARY CUTTER FOR A WOOD PLANING MACHINE

CROSS-REFERENCE TO RELATED APPLICATION

This application claims priority of Taiwanese Application No. 093203293, filed on Mar. 5, 2004.

BACKGROUND OF THE INVENTION

1. Field of the Invention

This invention relates to a rotary cutter for a wood planing machine, more particularly to a rotary cutter including a pair of blade-aligning members for aligning blades on a shaft.

2. Description of the Related Art

FIGS. 1 to 3 illustrate a conventional wood planing machine that includes a base 11, posts 12 standing upright from the base 11, a cutter carriage 13 mounted movably on the posts 12, and a rotary cutter 14 mounted rotatably on the cutter carriage 13. The rotary cutter 14 includes a shaft 15 that is formed with a plurality of first recesses 153, and a plurality of blades 16, each of which is mounted securely on the shaft 15 and each of which is disposed in a respective one of the first recesses 153. A pair of urging members 154 are disposed in each of the first recesses 153 for adjustment of the depth of the blade 16 in the respective first recess 153. A pressing plate 17 and screw means 19 are used for pressing the blade 16 against a mounting wall 155 of the shaft 15 upon adjustment of the screw means 19 to abut against an opposite wall 156 of the shaft 15 opposite to the mounting wall 155.

Since the first recesses 153 are very narrow, tightening and loosening of the screw means 19 are relatively inconvenient during replacement of the blades 16. Moreover, since the urging members 154 are likely to deform after a period of use and since the extent of deformation is not likely to be the same for the urging members 154, precise alignment of each blade 16 can be difficult to maintain.

SUMMARY OF THE INVENTION

Therefore, the object of this invention is to provide a rotary cutter for a wood planing machine that is capable of overcoming the aforesaid drawback of the prior art.

According to the present invention, a rotary cutter for a wood planing machine includes: an elongated shaft that defines a rotation axis, that has two opposite mounting ends, and at least one axially extending blade-mounting surface parallel to the rotation axis and extending between the mounting ends, and that is formed with threaded holes indented inwardly from the blade-mounting surface and aligned in an axial direction relative to the rotation axis; a pair of blade-aligning members, each of which is mounted on a respective one of the mounting ends of the shaft, and each of which is formed with at least one protrusion; at least one blade attached to the blade-mounting surface and having two opposite end portions, each of which is formed with a recess that receives the protrusion of a respective one of the blade-aligning members so as to permit alignment of the blade on the blade-mounting surface; at least one elongated blade-fastening plate attached to the blade-mounting surface of the shaft, formed with a plurality of through-holes that are respectively registered with the threaded holes in the blade-mounting surface, and cooperating with the blade-mounting surface to define a blade-receiving gap therebetween for receiving the blade therein; and a plurality of fastening screws, each of which extends through a respective one of the through-holes in the blade-fastening plate and the blade-receiving gap and engages threadedly a respective one of the threaded holes in the shaft so as to fasten the blade to the blade-mounting surface of the shaft upon tightening of the fastening screws.

BRIEF DESCRIPTION OF THE DRAWINGS

Other features and advantages of the present invention will become apparent in the following detailed description of the preferred embodiment of the invention, with reference to the accompanying drawings. In the drawings.

DETAILED DESCRIPTION OF THE PREFERRED EMBODIMENT

Figure 1:
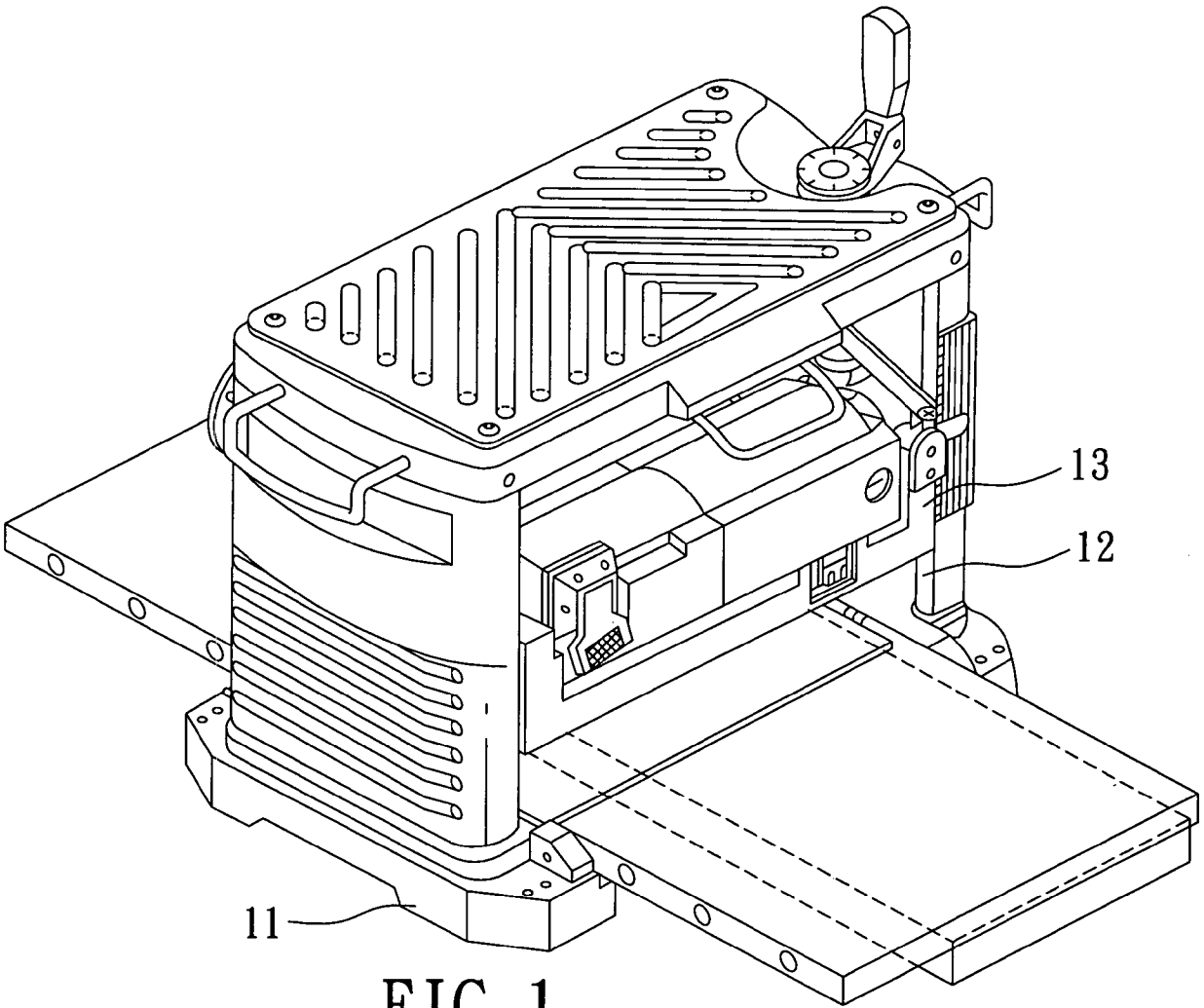
FIG. 1 PRIOR ART
FIG. 1 is a perspective view of a conventional wood planing machine.
Figure 2:
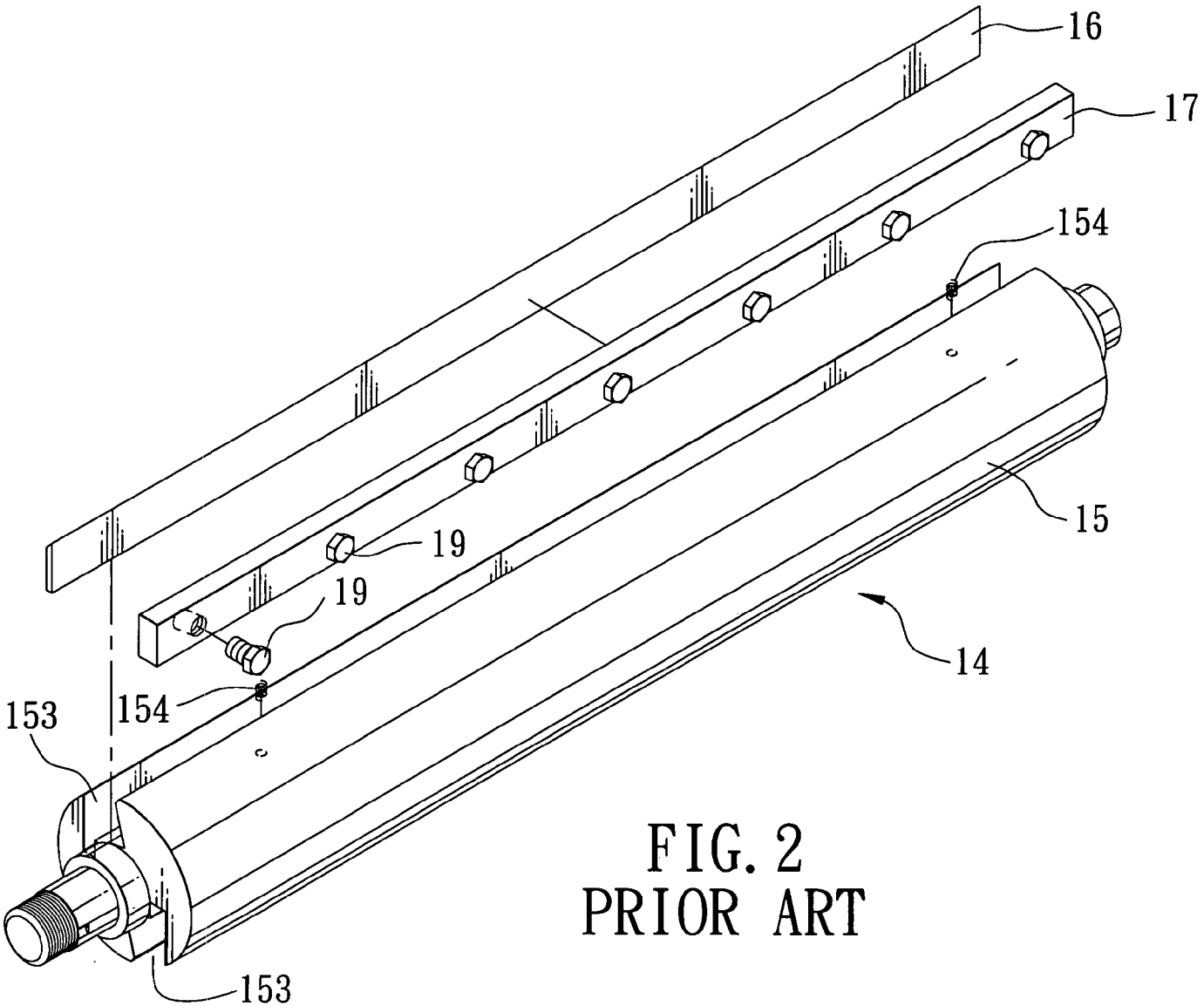
FIG. 2 PRIOR ART
FIG. 2 is an exploded perspective view of a rotary cutter of the conventional wood planing machine of FIG. 1.
Figure 3:
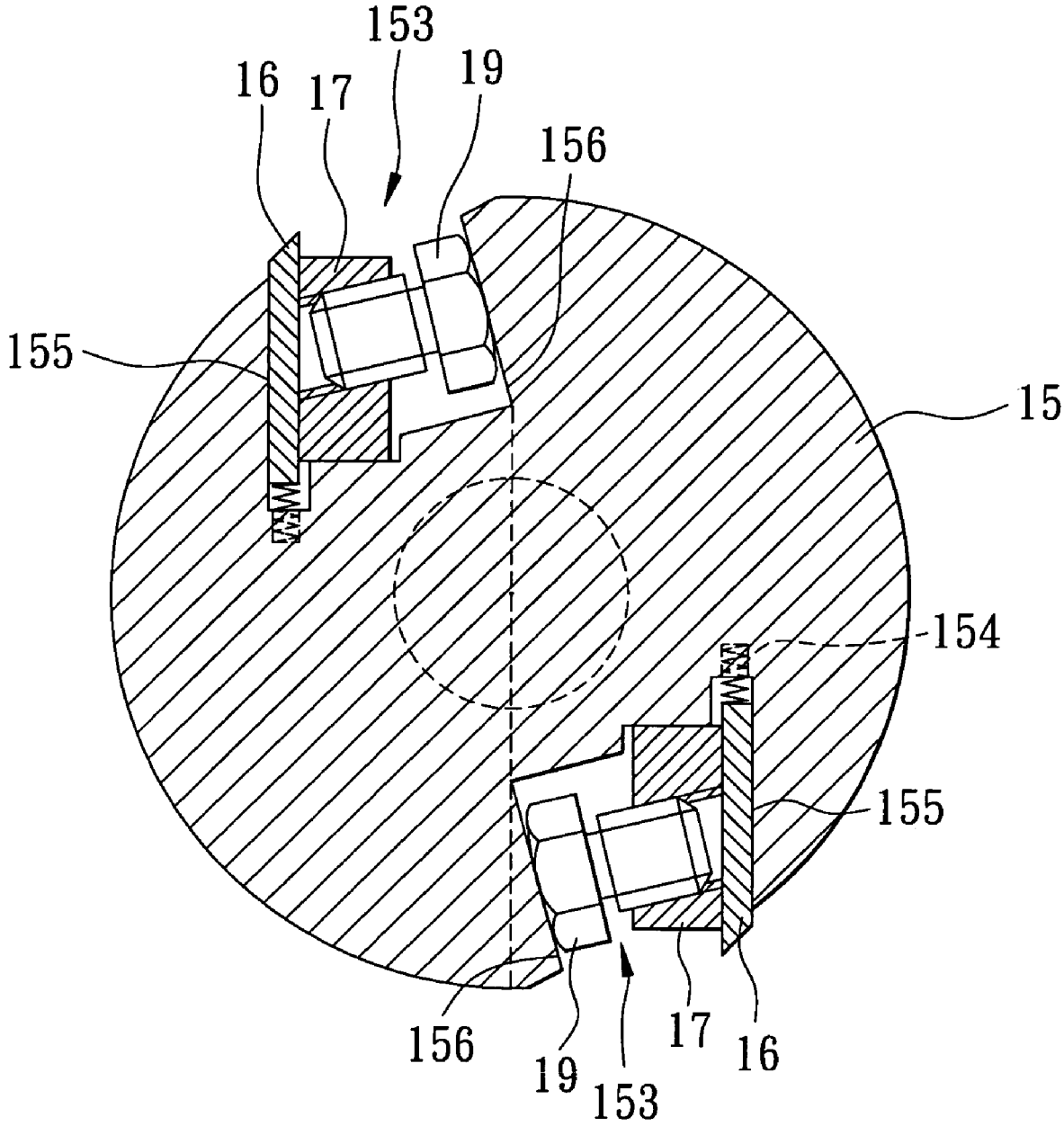
FIG. 3 PRIOR ART
FIG. 3 is a sectional view of the rotary cutter of the conventional wood planing machine of FIG. 1.
Figure 4:
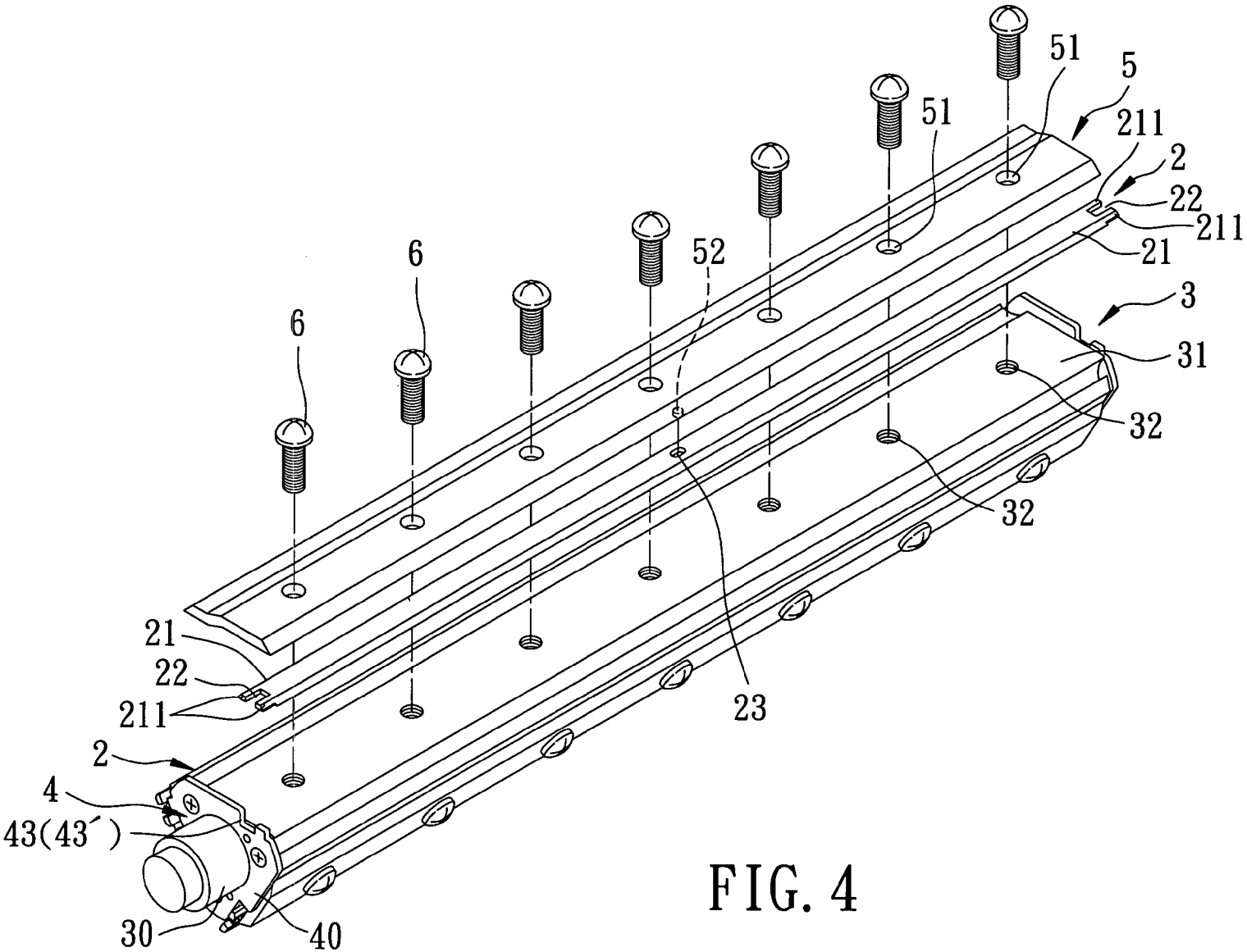
FIG. 4 is an exploded perspective view of the preferred embodiment of a rotary cutter for a wood planing machine according to this invention.
Figure 5:
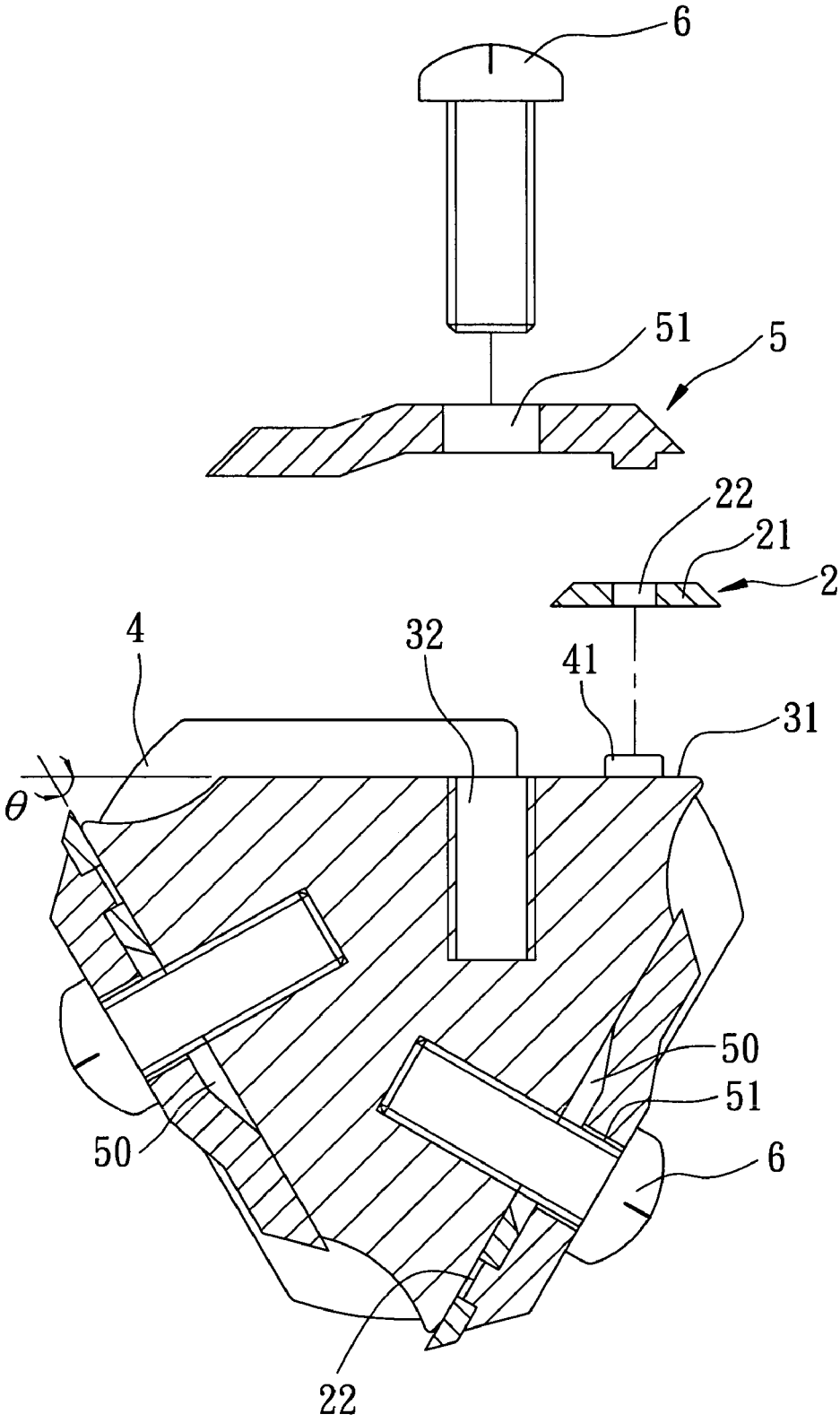
FIG. 5 is a partly exploded, sectional view of the preferred embodiment of this invention, illustrating how a blade is assembled to a shaft of the preferred embodiment.
Figure 6:
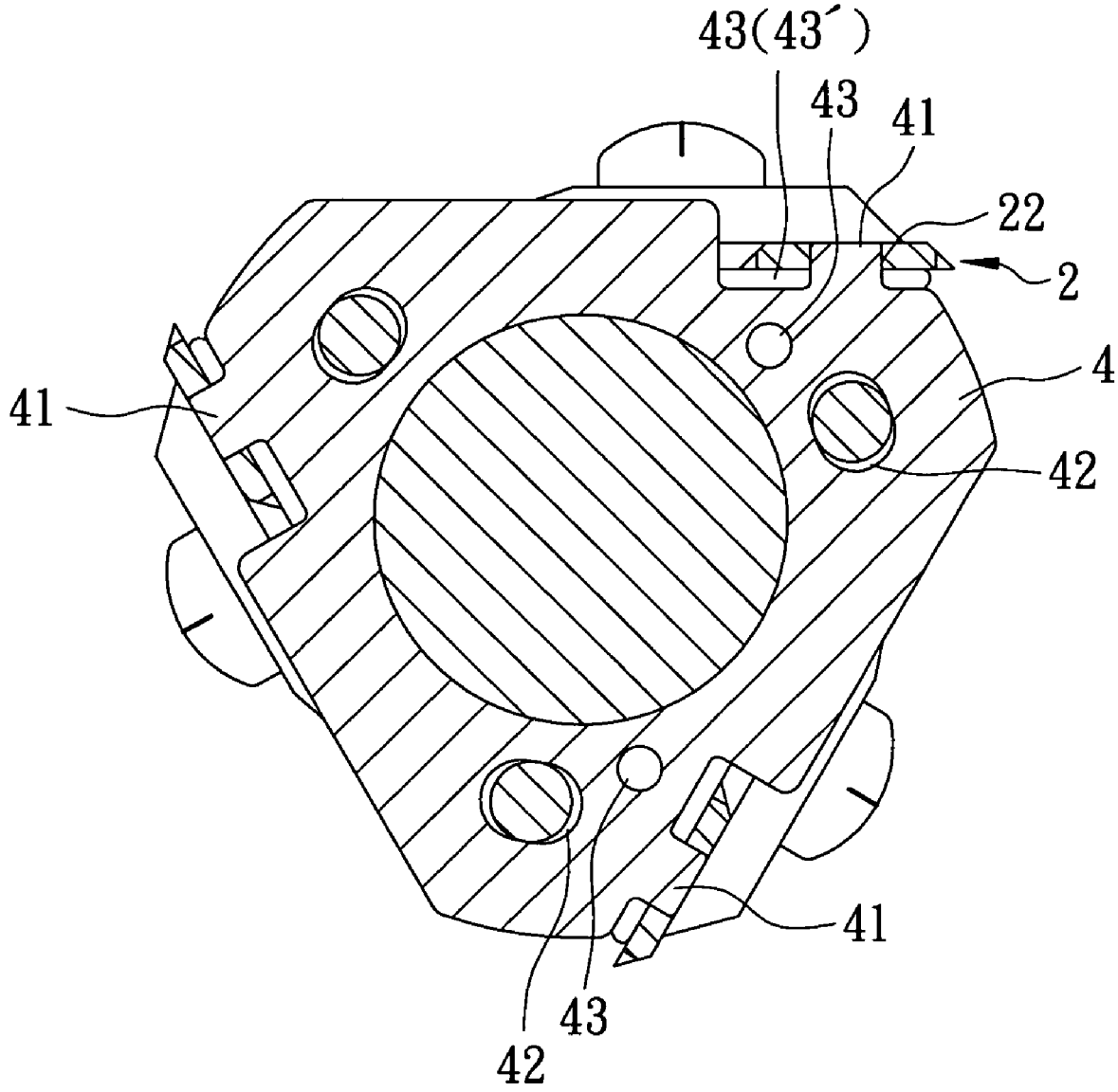
FIG. 6 is an assembled sectional view of the preferred embodiment of this invention.

FIGS. 4 to 6 illustrate the preferred embodiment of a rotary cutter for a wood planing machine according to this invention.

The rotary cutter includes: an elongated shaft 3 that defines a rotation axis, that has two opposite mounting ends 30, and at least one axially extending blade-mounting surface 31 parallel to the rotation axis and extending between the mounting ends 30, and that is formed with threaded holes 32 indented inwardly from the blade-mounting surface 31 and aligned in an axial direction relative to the rotation axis; a pair of blade-aligning members 4, each of which is mounted on a respective one of the mounting ends 30 of the shaft 3, and each of which is formed with at least one protrusion 41; at least one blade 2 attached to the blade-mounting surface 31 and having two opposite end portions 21, each of which is formed with a first recess 22 that receives the protrusion 41 of a respective one of the blade-aligning members 4 so as to permit alignment of the blade 2 on the blade-mounting surface 31; at least one elongated blade-fastening plate 5 attached to the blade-mounting surface 31 of the shaft 3, formed with a plurality of through-holes 51 that are respectively registered with the threaded holes 32 in the blade-mounting surface 31, and cooperating with the blade-mounting surface 31 to define a blade-receiving gap 50 therebetween for receiving the blade 2 therein; and a plurality of fastening screws 6, each of which extends through a respective one of the through-holes 51 in the blade-fastening plate 5 and the blade-receiving gap 50 and engages threadedly a respective one of the threaded holes 32 in the shaft 3 so as to fasten the blade 2 to the blade-mounting surface 31 of the shaft 3 upon tightening of the fastening screws 6.

Each of the blade-aligning members 4 includes a plate 40 sleeved on the respective one of the mounting ends 30 of the shaft 3 and secured to the shaft 3. The plate 40 is formed with a second recess 43 defined by a recess-defining wall 43'. The protrusion 41 protrudes from the recess-defining wall 43' into the second recess 43, and has two opposite sides that are opposite to each other in a transverse direction relative to the axial direction. Each of the end portions 21 of the blade 2 is formed with two fingers 211 that cooperatively define the first recess 22. The fingers 211 extend into the second recess 43, and are respectively disposed at the sides of the protrusion 41. The plate 40 of each of the blade-aligning members 4 is formed with a plurality of screw holes 42 for extension of screw means therethrough, and positioning holes 43 for extension of alignment studs (not shown) therethrough.

The blade-fastening plate 5 is formed with a blade-aligning stud 52 projecting therefrom. The blade 2 is formed with a through-hole 23 for extension of the blade-aligning stud 52 therethrough.

In this embodiment, the shaft 3 is polygonal in shape, and has a plurality of the blade-mounting surfaces 31 that surround the rotation axis and that are equidistant from the rotation axis for mounting of a plurality of the blades 2 thereon. Two adjacent ones of the blade-mounting surfaces 31 define an angle θ therebetween. The angles θ defined by the blade-mounting surfaces 31 are equal.

Figure 7:
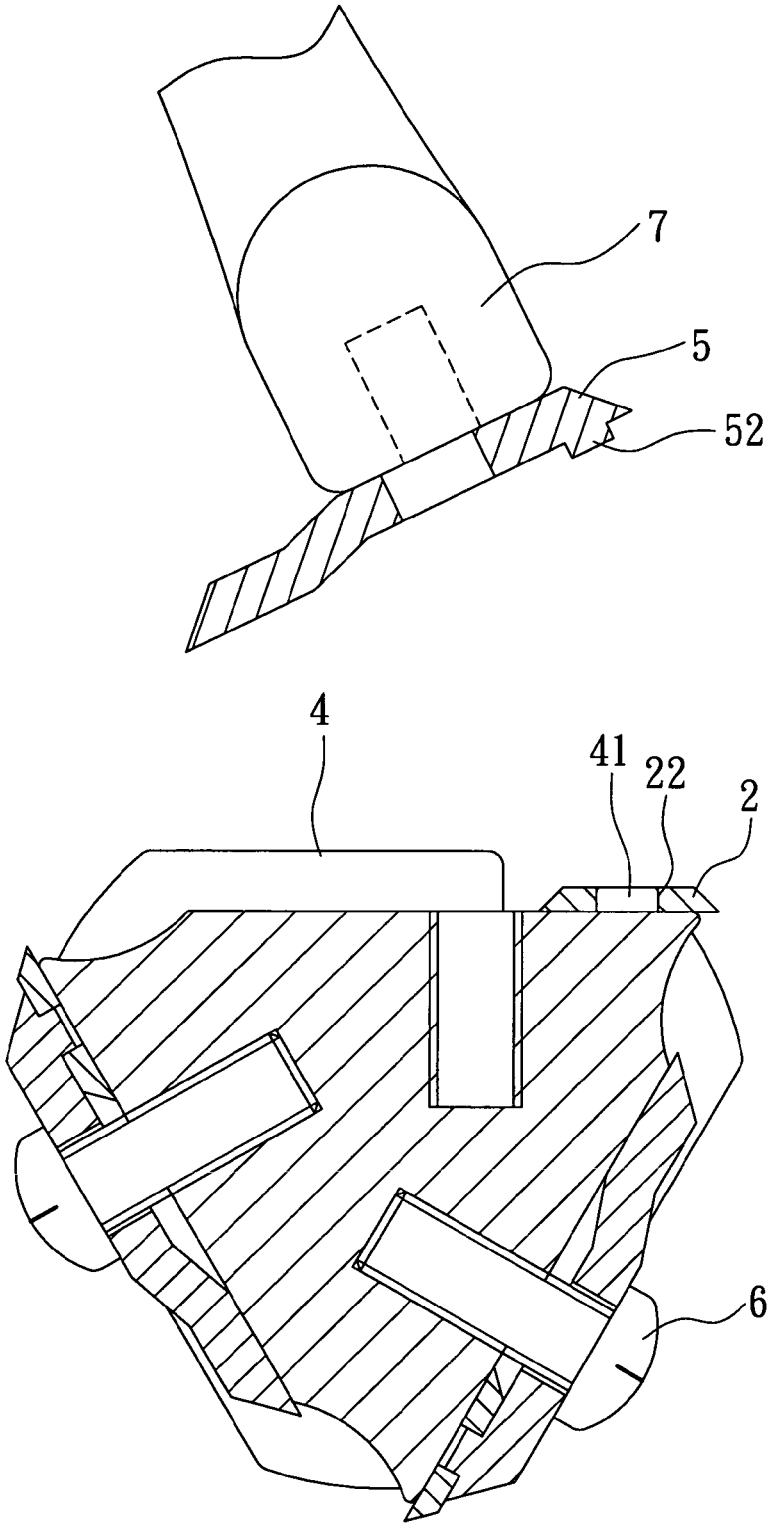
FIG. 7 is a partly exploded, sectional view of the preferred embodiment of this invention, illustrating how the blade is disassembled from the shaft of the preferred embodiment.

Referring to FIG. 7, the blade 2 can be easily replaced by loosening the fastening screws 6 thereon, and removed subsequently from the blade-mounting surface 31 of the shaft 3 using a magnet 7.

Since heads of the fastening screws 6 can be easily accessed, the blades 2 on the blade-mounting surfaces 31 of the shaft 3 can be easily replaced. Moreover, by virtue of the protrusions 41 of the blade-aligning members 4 and the recesses 22 in the end portions 21 of the blade 2, each blade 2 can be easily aligned during mounting of the blade 2 on the blade-mounting surface 31 of the shaft 3, thereby eliminating the drawback associated with the prior art.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A rotary cutter for a wood planing machine, comprising:

an elongated shaft that defines a rotation axis, that has two opposite mounting ends, and at least one axially extending blade-mounting surface parallel to said rotation axis and extending between said mounting ends, and that is formed with threaded holes indented inwardly from said blade-mounting surface and aligned in an axial direction relative to said rotation axis;

a pair of blade-aligning members, each of which is mounted on a respective one of said mounting ends of said shaft, and each of which is formed with at least one protrusion;

at least one blade attached to said blade-mounting surface and having two opposite end portions, each of which is formed with a first recess that receives said protrusion of a respective one of said blade-aligning members so as to permit alignment of said blade on said blade-mounting surface;

at least one elongated blade-fastening plate attached to said blade-mounting surface of said shaft, formed with a plurality of through-holes that are respectively registered with said threaded holes in said blade-mounting surface, and cooperating with said blade-mounting surface to define a blade-receiving gap therebetween for receiving said blade therein; and a plurality of fastening screws, each of which extends through a respective one of said through-holes in said blade-fastening plate and said blade receiving gap and engages threadedly a respective one of said threaded holes in said shaft so as to fasten said blade to said blade-mounting surface of said shaft upon tightening of said fastening screws.

2. The rotary cutter of claim 1, wherein each of said blade-aligning members includes a plate sleeved on the respective one of said mounting ends of said shaft and secured to said shaft, said plate being formed with a second recess defined by a recess-defining wall, said protrusion protruding from said recess-defining wall into said second recess and having two opposite sides that are opposite to each other in a transverse direction relative to said axial direction, each of said end portions of said blade being formed with two fingers that cooperatively define said first recess, said fingers extending into said second recess and being respectively disposed at said two opposite sides of said protrusion.

3. The rotary cutter of claim 1, wherein said blade-fastening plate is formed with a blade-aligning stud projecting therefrom, said blade being formed with a through-hole for extension of said blade-aligning stud therethrough.

4. The rotary cutter of claim 1, wherein said shaft is polygonal in shape, and has a plurality of said blade-mounting surfaces that surround said rotation axis and that are equidistant from said rotation axis, two adjacent ones of said blade-mounting surfaces defining an angle therebetween, said angles defined by said blade-mounting surfaces being equal.

* * * * *